United States Patent [19]

Nebgen et al.

[11] Patent Number: 4,667,117

[45] Date of Patent: May 19, 1987

[54] SELF-TIMING AND SELF-COMPENSATING PRINT WIRE ACTUATOR DRIVER

[75] Inventors: Gilbert B. Nebgen, Round Rock; Rafael Pelc, Austin, both of Tex.

[73] Assignee: International Business Machines Corporation, Armonk, N.Y.

[21] Appl. No.: 666,793

[22] Filed: Oct. 31, 1984

[51] Int. Cl.[4] ..... H01H 47/32

[52] U.S. Cl. ..... 307/154; 307/155; 361/152; 361/153; 361/154; 400/157.3; 101/93.04

[58] Field of Search ..... 307/154, 155; 361/139, 361/152, 153, 154, 155, 156, 157, 159, 160, 168.1, 169.1, 187, 190; 400/121, 120, 157.3, 144.3, 279, 320, 322, 305; 101/93.02, 93.03, 93.04, 93.29, 93.30

[56] References Cited

U.S. PATENT DOCUMENTS

| | | | |
|---|---|---|---|
| 3,628,100 | 12/1971 | Zettler | 361/152 |
| 3,859,572 | 1/1975 | Keidl et al. | 361/153 |
| 3,909,681 | 9/1975 | Campari et al. | 361/154 |
| 4,048,665 | 9/1977 | Lia et al. | 361/152 |
| 4,102,265 | 7/1978 | Deetz | 101/93.03 |
| 4,262,592 | 4/1981 | Araki | 400/157.3 X |
| 4,284,876 | 8/1981 | Ishibashi et al. | 101/93.04 X |
| 4,293,888 | 10/1981 | McCarty | 361/152 |
| 4,315,297 | 2/1982 | Kobayashi et al. | 361/93 X |
| 4,360,855 | 11/1982 | Ohba | 361/154 |
| 4,377,144 | 3/1983 | Takahashi | 361/152 X |
| 4,384,520 | 5/1983 | Nakano et al. | 400/157.3 X |
| 4,453,194 | 6/1984 | Frankeny et al. | 361/154 |
| 4,485,425 | 11/1984 | Grüner et al. | 361/153 |

FOREIGN PATENT DOCUMENTS

| | | | |
|---|---|---|---|
| 0019890 | 10/1980 | European Pat. Off. . | |
| 0124382 | 11/1984 | European Pat. Off. | 101/93.29 |

*Primary Examiner*—William M. Shoop, Jr.
*Assistant Examiner*—Shik Luen Paul Ip
*Attorney, Agent, or Firm*—Andrea P. Bryant

[57] ABSTRACT

There is disclosed an improved drive circuit for a print element actuator wherein the current applied to the actuator has a fast rise mode which is terminated when a predetermined level has been reached. Current is allowed to slowly decay through the circuit until it reaches a second and lower predetermined level. The circuit is self-timing and self-compensating for variations in voltage or actuator impedance.

10 Claims, 6 Drawing Figures

SELF-TIMING AND SELF-COMPENSATING PRINT WIRE ACTUATOR DRIVER

TECHNICAL FIELD

This invention relates to printhead driver circuits for wire matrix printers. More specifically, it relates to a print wire actuator driver circuit which is self-timing and self-compensating using a single drive voltage.

BACKGROUND ART

Circuits are known for driving print wire actuators for matrix printheads and high speed printers. These circuits may regulate current using a pedestal scheme, a chopper scheme, or an on/off type drive and are illustrated in FIGS. 1, 2 and 3, respectively.

The pedestal driver, FIG. 1, requires dual drive voltages, one high for the initial charge and a lower voltage to sustain current. A chopper type driver, FIG. 2, requires only a single drive voltage, but neither the pedestal nor chopper drivers provide pulse width control without the addition of a timing circuit, one for each actuator. Also, for the chopper driver, precautions must be taken to prevent signal noise from affecting circuit operation.

An on/off type driver, FIG. 3, provides the advantages of a single drive voltage and pulse width control but offers the drawback that it requires a resistor or diode in the flyback path in order to quickly discharge current. Current must be discharged rapidly in this scheme in order to maintain a fast actuator repetition rate. While this scheme offers significant advantages, the diode or the like in the flyback path unnecessarily wastes a significant amount of power required to fire the actuator.

U.S. Pat. No. 3,909,681 to Campari et al discloses a drive circuit for an electromagnetic coil for hammer actuation in a high speed impact printer. The driver employs two switching devices, one above the coil and one below the coil, for controlling the current. The drive circuit employs one circuit device for controlling the peak current value. Current pulse width is controlled by external logic which also initiates the start of the current pulse. The circuit is not self-timing and cannot automatically adjust current pulse width to compensate for power supply or coil impedance variations.

DISCLOSURE OF THE INVENTION

The present invention solves the pulse width timing problems of the chopper and pedestal driver types described above and also solves the energy efficiency problems associated with the on/off driver scheme. This is accomplished by employing two switching transistors, one switching the voltage to the actuator and one switching the current return path. Using a current sensing means in the return path and two threshold sensing comparators makes the circuit self-timing as well as self-compensating for variations in voltage.

The driver circuit of the present invention overcomes the shortcomings of the prior art by using the current level threshold to terminate the charge period while also providing a slow discharge sensing technique to set pulse width. A specified energy level is applied to the actuator in a minimal period of time. The pulse width of the drive current is controlled, the actuator is discharged at the end of the pulse, and a single power supply is required.

The following advantages proceed from the present invention. Unnecessary processor overhead is avoided for independently timing the pulse width for each of the wire actuators. The circuit is self-compensating for temperature and voltage variations because switching occurs only at constant current points and current is discharged in an efficient manner back to the power supply.

BRIEF DESCRIPTION OF DRAWINGS

A better understanding of the present invention may be had from the following description taken in conjunction with the accompanying drawing wherein.

BEST MODE FOR CARRYING OUT THE INVENTION

A preferred embodiment of the present invention will be described having reference to FIGS. 4 and 5.

Figure 1:
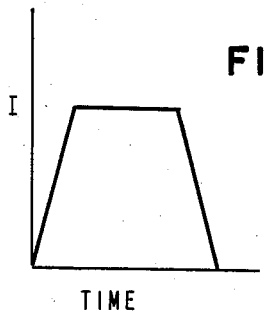
FIGS. 1, 2 and 3 illustrate wave forms generated by prior art driver types.
Figure 2:
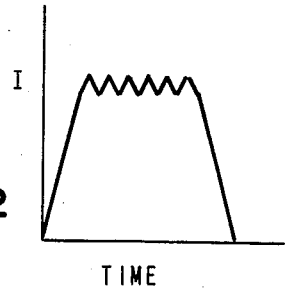
Figure 3:
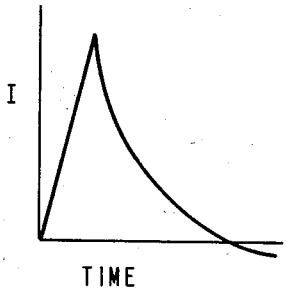
Figure 4:
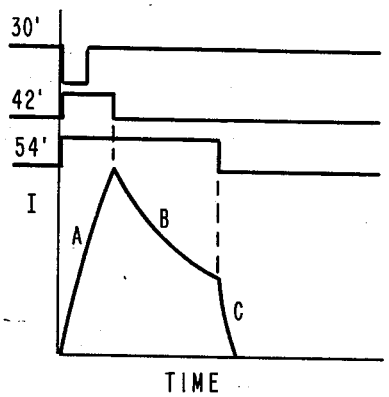
FIG. 4 illustrates the wave form produced by the circuit of the present invention.

FIG. 4 illustrates the wave form of a current pulse along with timing signals produced by the circuit arrangement of the present invention. Section A represents the "fast charge mode" of a print hammer firing sequence. A switch in the circuit allows current to flow through the actuator coil for firing the print hammer. Once the current in the coil reaches a predetermined level as detected by means in the drive circuit, the switch state changes to prevent increasing current flow through the coil.

The current in the coil follows another path as it gradually decays as shown at section B of FIG. 4. Once the current level reaches a predetermined, lower reference value, another switch in the circuit changes state forcing current remaining in the coil to yet a third path as represented by section C of FIG. 4.

Figure 5:
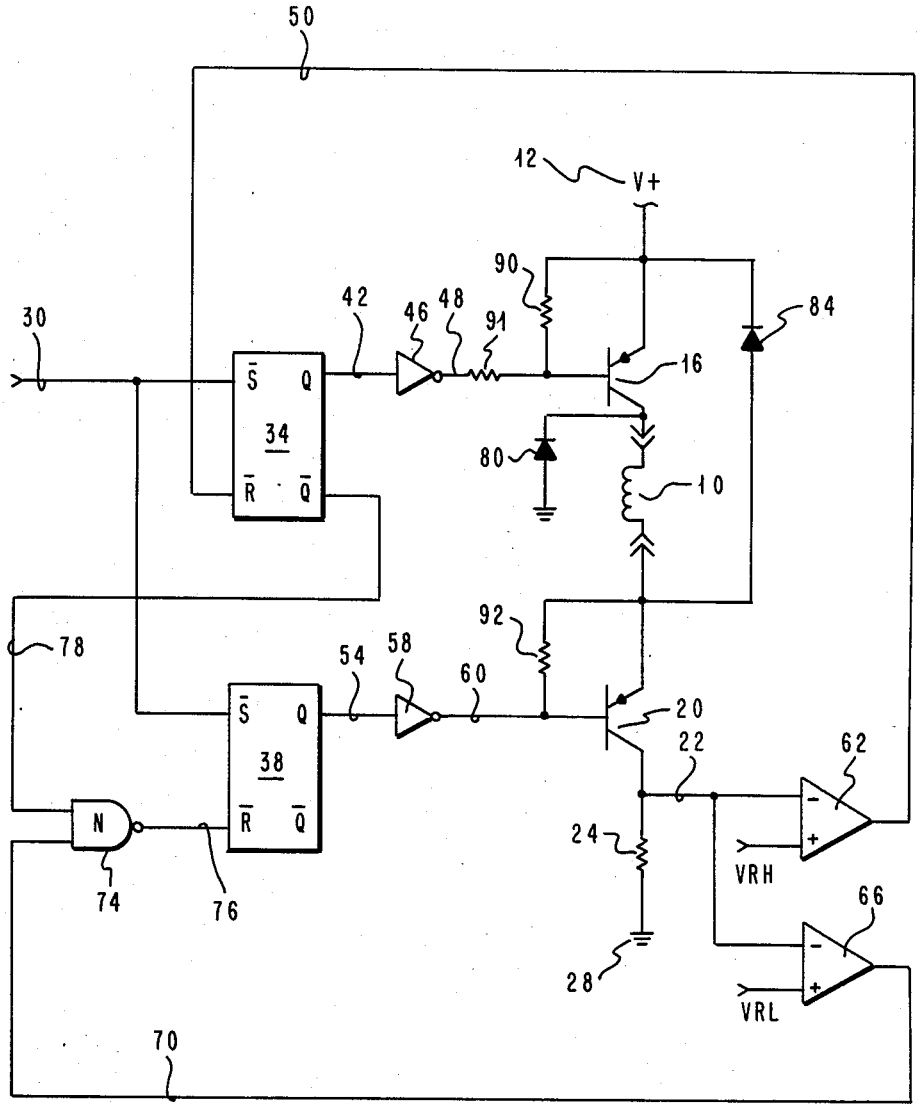
FIG. 5 is a circuit schematic for the drive scheme of the present invention.

FIG. 5 is a circuit schematic for implementing the drive scheme illustrated in the pulse wave form of FIG. 4. In order to have the current pulse illustrated in FIG. 4, section A, flow through the print wire actuator coil 10, current must flow from power supply 12 through switch 16 to coil 10 through switch 20 through resistor 24 to ground indicator 28.

In order to accomplish this result an input trigger pulse on line 30 is applied to the $\overline{S}$ input of latches 34 and 38. The trigger input pulse on line 30 is applied by the control system of the printer, or the like, in which the present drive scheme is embodied. The Q output of latch 34 on line 42 is applied to inverter driver 46. The Q output from latch 38 on line 54 is applied to inverter driver 58.

Current flowing through switch 20 is monitored on line 22 and a proportional voltage is applied to the negative inputs of comparators 62 and 66. The positive input to comparator 62 is VRH a reference voltage set high. The output of comparator 62 on line 50 is the $\overline{R}$ input to latch 34. The other, positive, input to comparator 66 is VRL a reference voltage set low. The voltage level of VRH and VRL are chosen as a function of the operating characteristics of the print element to be actuated.

The output of comparator 66 on line 70 is one input to NAND gate 74. NAND gate 74 has its output on line 76 which is applied to the $\overline{R}$ input of latch 38. The other input to NAND gate 74 on line 78 is the Q output from latch 34. A grounded diode 80 is connected between switch 16 and coil 10. Diode 84 is connected between switch 20 and coil 10 and to power supply 12. Resistors 90, 91 and 92 serve as biasing resistors for transistor switches 16 and 20.

In operation, the signal on line 30 is momentarily pulsed low causing the Q outputs of both latches 34 and 38 on lines 42 and 54, respectively, to go high. See timing signals in FIG. 4 where the states of lines 30, 42 and 54 of FIG. 5 are represented as 30', 42' and 54', respectively. The Q output of latch 34 is high and stays high because its $\overline{R}$ input on line 50 from comparator 62 is high. This is the case because there is yet no current through sensing resistor 24 and the positive voltage VRH is higher than the voltage of line 22. The Q output on line 54 from latch 38 will also remain high because its $\overline{R}$ input on line 76 from NAND gate 74 is high and will stay high until both inputs to NAND gate 74 on lines 70 and 78, respectively, go high. The Q output of latch 38 cannot be switched low until the $\overline{Q}$ output from latch 34 on line 78 goes high since line 78 is an input to NAND gate 74. Latch 38 is thus presently inhibited from being reset until after latch 34 is reset.

Inverting drivers 46 and 58 receive high inputs from lines 42 and 54, respectively. Consequently, the outputs on lines 48 and 60 are low. When the signal on line 48 goes low, switch transistor 16 switches to the ON state. In a similar manner a low output on line 60 switches switch transistor 20 to the ON state. When both switch transistors 16 and 20 are in the ON state, voltage from power supply 12 is applied to actuator coil 10. Current begins to increase quickly in the fast charge mode. See section A, FIG. 4.

As current through coil 10 continues to rise so does the current through sensing resistor 24. A voltage proportional to the current in coil 10 appears across resistor 24 on line 22. When the voltage on line 22 reaches the level of VRH in comparator 62, the output of comparator 62 on line 50 switches low to reset latch 34. This results in the signal on line 42 going low to turn inverting driver 46 OFF. Thus, switching transistor 16 is also turned OFF.

Once switch transistor 16 turns OFF, current in coil 10 must find an alternate path of conduction. Diode 80 is forced into conduction and the current path is diode 80, coil 10, through switch 20 and resistor 24 to ground. This corresponds to section B of FIG. 4. Once power supply 12 is switched out of the circuit, the current through coil 10 decays slowly.

When latch 34 is reset, line 78 goes high making NAND gate 74 responsive to the signal on line 70 from comparator 66. At this point in the operating cycle the signal on line 70 is low because the reference voltage VRL applied to comparator 66 is set to a positive voltage level below that of VRH applied to comparator 62. VRL and VRH are set to specific values chosen to optimize performance for a given printhead type.

Current in coil 10 continues to decay until the voltage on line 22 falls to a value below that of VRL. When this occurs comparator 66 switches the signal on line 70 ON. The signal on line 70 is applied to NAND gate 74. The output on line 76 goes low to reset latch 38 which results in inverting driver 58 being turned OFF. This, of course, turns off switch transistor 20.

Once switch transistor 20 is OFF, the current through coil 10 finds yet another path of conduction. Diode 84 is turned on and completes the path from diode 80 through coil 10 back to power supply 12. At this point in the cycle coil 10 must generate a voltage slightly above the voltage of power supply 12. Energy is thus transferred rapidly back to the power supply from the actuator coil. Current in coil 10 subsequently decays very quickly as represented in section C of FIG. 4.

The drive scheme embodied in the circuit of FIG. 5 is self-timing. A single short duration trigger pulse applied to line 30, as illustrated in the timing diagrams of FIG. 4, causes both latches 34 and 38 to be set, after which time the circuit is locked into the automatic performance of the remainder of the cycle as described above. No pulse width timing is required from input 30 since it serves only to initiate the cycle.

Figure 6:
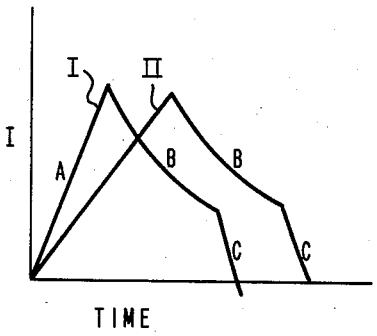
FIG. 6 illustrates the effect of power supply variation on the wave form produced by the circuit of FIG. 5.

Refer now to FIG. 6 for a better understanding of how the circuit of FIG. 5 is self-compensating. FIG. 6 illustrates the effect of power supply or coil 10 impedance variation. Curve I in FIG. 6 is initiated under a higher power supply voltage condition than that of curve II. The current in curve II then takes longer to reach the first switch point, that is, voltage at sensing point 22 at least equal to or greater than VRH. The larger area under curve II, however, indicates the self-compensating nature of the present drive scheme. Actuator speed which may have been lost early in the cycle due to the lower power supply is compensated by the larger total amount of energy supplied to coil 10. In the same manner, compensation also occurs when coil impedance varies. Because switching occurs at constant current points the area under wave form II is slightly larger than that under wave form I. The larger area represents additional energy in the actuator coil.

Section C of FIG. 4 and the corresponding portions of FIG. 6 illustrate an important advantage of this drive scheme when used to drive actuators at fast repetition rates. If current were not discharged quickly, the rebound velocity of the actuated hammer would be slowed and the hammer might not return in time for a subsequent cycle.

While the invention has been particularly shown and described having a reference to a preferred embodiment, it will be understood by those skilled in the art that variations in form and detail may be made without departing from the spirit and scope of the invention.

We claim:

1. A method of driving a print element actuator coil comprising:

supplying potential to a first switchable device connected to one terminal of the actuator coil, through the coil to a second switchable device connected at the other terminal of the coil, to ground;

sensing the current at the second switchable device;

making the first switchable device nonconductive when the current is at a first predetermined level; and making the second switchable device nonconductive when the current is at a second, lower predetermined value.

2. The method of claim 1 including the additional step of inhibiting switching of the second switchable device until the first switchable device has been switched.

3. A drive circuit for controlling current flow from a source of potential through an actuator coil, said circuit including:

a first current path from said source through said actuator coil;

a low potential return path;

a first device switchable between conducting and nonconducting modes for enabling the first current path;

a second device switchable between conducting and nonconducting modes for connecting said actuator coil to the low potential return path;

sensing means operable while the second device is in its conducting mode for sensing current level through the actuator coil;

first means responsive to the sensing means for switching the first device to its nonconducting mode when the current level is substantially equal to a first predetermined level;

second means responsive to the sensing means for switching the second device to its nonconducting mode when the current level is less than a second, lower predetermined level; and a return conduction path from the actuator coil to the source of potential.

4. The circuit of claim 3 additionally comprising means for preventing the second switch means from being operable prior to the first switching means completing its operation.

5. The circuit of claims 3 or 4 wherein said first and second devices switchable to conducting or nonconducting modes are transistors.

6. The circuit of claim 4 wherein said first and second switch means comprise latching means operable in response to an input trigger signal.

7. The circuit of claims 3, 4 or 6 wherein the actuator coil actuates a print wire in a wire matrix printer.

8. Circuit apparatus for driving an actuator coil connected in series between two switches at their ends, the first switch being connected also to a source of positive potential;

and the second switch being connected also to a source of negative potential with respect to the source of positive potential;

a latch means associated with each switch, responsive to an input trigger pulse for latching its associated switch into its conducting state;

means responsive to the current level at the second switch for resetting the latch associated with the first switch when the current level reaches a first predetermined value; and second means responsive to the current level at said second switch for resetting the latch associated with the second switch when the current level reaches a second, lower predetermined value and the first latch has been reset.

9. The circuit apparatus of claim 8 wherein the first and second switches are transistors.

10. Apparatus for driving a print wire actuator in a wire matrix printer comprising:

a power supply means;

a first switch connected between the power supply and the actuator;

a second switch connected between the actuator and ground;

means for inducing current flow from said power supply through the actuator, for monitoring current through the second switch;

means responsive to the current level in the second switch for turning off the first switch; and means responsive to the current level in the second switch for turning off the second switch only after the first switch is turned off.

* * * * *